US005812906A

United States Patent [19]

Staudenmayer et al.

[11] Patent Number: 5,812,906

[45] Date of Patent: Sep. 22, 1998

[54] FUSER HAVING THERMOELECTRIC TEMPERATURE CONTROL

[75] Inventors: William J. Staudenmayer, Pittsford; Daniel D. Haas, Webster, both of N.Y.

[73] Assignee: Eastman Kodak Company, Rochester, N.Y.

[21] Appl. No.: 662,563

[22] Filed: Jun. 10, 1996

[51] Int. Cl.[6] ..... G03G 15/20

[52] U.S. Cl. ..... 399/69; 399/330; 399/331

[58] Field of Search ..... 399/69, 320, 328, 399/330, 331, 335; 219/216

[56] References Cited

U.S. PATENT DOCUMENTS

| | | | |
|---|---|---|---|
| 4,540,251 | 9/1985 | Yau et al. | 350/611 |
| 4,628,183 | 12/1986 | Satomura | 219/216 |
| 4,687,319 | 8/1987 | Mishra | 399/250 |
| 5,089,363 | 2/1992 | Rimai et al. | 430/45 |
| 5,119,142 | 6/1992 | Swapecinski et al. | 355/285 |
| 5,182,606 | 1/1993 | Yamamoto et al. | 399/335 |
| 5,235,393 | 8/1993 | Merle | 355/282 |
| 5,450,182 | 9/1995 | Wayman et al. | 399/328 |

FOREIGN PATENT DOCUMENTS

| | | |
|---|---|---|
| 1-035112 | 2/1989 | Japan . |
| 1-072171 | 3/1989 | Japan . |
| 2-217876 | 8/1990 | Japan . |

OTHER PUBLICATIONS

Stanley W. Angrist, Direct Energy Conversion, 1977, 166–167.

*Primary Examiner*—Fred L. Braun
*Attorney, Agent, or Firm*—Lawrence P. Kessler

[57] ABSTRACT

A fuser for fixing toner, for example, toner images, includes thermoelectric control devices for controlling temperature. Preferably, the thermoelectric control devices are used to heat the toner in a heating zone and cool the toner in a cooling zone prior to separation of the toner from a fusing surface. The cooling improves both the gloss and the separation characteristics of the toner.

17 Claims, 2 Drawing Sheets

FUSER HAVING THERMOELECTRIC TEMPERATURE CONTROL

This invention relates to the fusing of toner to a surface.

U.S. Pat. No. 5,089,363 to Rimai et al is representative of a number of references which suggest the fusing of toner images to a sheet by first heating the toner image while in contact with a smooth, hard fusing surface to soften the image and then cooling the image before separation of the sheet and the surface. Allowing the image to cool before separation improves both the gloss of the image and the separation characteristics of the image to the point where, in many instances, no release liquid is needed on the surface.

U.S. Pat. No. 5,235,393, issued to Merle, discloses a fuser in which a toner image is contacted by a metallic belt with heat being applied in a pressure nip to soften and flatten the toner image. As the belt moves away from the pressure nip, it is air cooled to bring the temperature of the toner below its glass transition temperature before separation of the sheet from the belt.

U.S. Pat. No. 5,119,142 to Swapceinski also discloses a metallic belt fuser. A heat transfer device conveys heat from a portion of the belt leading away from the nip to a portion of the belt approaching the nip. This cools the image contacting the first portion and applies the removed heat to the fusing portion.

Fusers of the type described in these references provide extremely high quality images and are attractive for use in making high quality glossy color toner images free of release oil. However, the cooling process itself is expensive and creates its own set of problems, including cooling hardware and space consumption. Further, the belts are expensive and create their own sets of problems, including tracking and space consumption.

SUMMARY OF THE INVENTION

It is an object of the invention to provide improvements in the aforementioned types of fusers.

This and other objects are accomplished by the use of thermoelectric control devices to heat and/or cool toner in a fuser.

According to a preferred embodiment, a fuser for fusing toner (for example, a toner image) carried on a receiving surface moving in an in-track direction includes a fusing member having a fusing surface for contacting the toner. The fusing surface is movable with the toner image as the receiving surface moves in the in-track direction. The fuser further includes means for heating the toner while the toner is in a heating zone to soften the toner and means for cooling the toner while the toner image is in a cooling zone and still in contact with the fusing surface to improve the gloss and/or the release characteristics of the toner. Means for separating the receiving surface from the fusing surface is positioned after the toner has passed through at least a portion of the cooling zone. The means for heating and/or the means for cooling include a thermoelectric control device (TECD) having thermoelectric couples capable of controlling the temperature of the fusing surface according to an electrical polarity across them.

Although the invention can be used to fuse a uniform layer of toner to a surface for protection and/or gloss enhancement, it has particular utility in fusing toner images, especially multicolor toner images to quality receiving sheets on webs. The ability to fuse multicolor toner images without offset-preventing liquids allows very high quality reproduction.

According to a preferred embodiment, the TECD can be used in a system in which it does not move with the fusing surface but provides a sharp reduction in temperature of the toner image after fusing but before separation, thereby adding control and compactness to the system. In preferred embodiments in which the TECD is movable with the receiving surface, the polarity of the thermoelectric couples is reversed as they pass from the heating zone to the cooling zone. In these embodiments the element change from heating to cooling during that passage. This greatly simplifies the fusing system and provides the capability of positioning the TECD closer to the fusing surface. It also allows a unique control of the process (including gloss) by adjustment of the temperature switching point.

In all embodiments, the TECD adds the advantages of compactness, temperature control and heat confinement. Cooling is accomplished efficiently by direct conduction.

DETAILED DESCRIPTION OF THE INVENTION

A TECD controls temperature according to the electric polarity across its process elements. The process elements can either be dissimilar metals, incorporating a Peltier effect, or a thermoelectric couple consisting of N and P type semiconductor materials. A TECD can contain as few as one couple to as many as can be accommodated by the available power supplies. Regulation of polarity and current allows for heating or cooling.

Such devices have been well known for years. See, for example, *Direct Energy Conversion* by Stanley W. Angrist, Third Edition, pp. 166–167, published 1978 by Allyn and Bacon, Inc. of Boston. The devices are also sometimes called "thermoelectric heat pumps;" see, for example, U.S. Pat. No. 4,540,251 to Yau et al, issued Sep. 10, 1985.

The devices have many advantages that make them particularly useful in fusers. They are solid state devices accomplishing cooling or heating with no moving parts; they can be small in size and weight; they only need electrical power to both control and supply the energy for cooling and heating; and they can quickly change the amount of heat that they transfer or switch from heating to cooling by simply changing the amount or polarity of applied electrical power.

Figure 1:
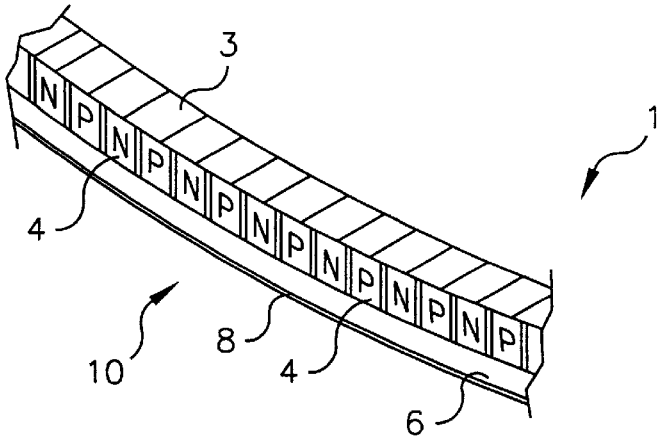
FIG. 1 is a schematic section of a portion of a fusing roller.

According to FIG. 1, a fusing member 1, which can be a roller, belt or other comparable device, includes a core 3 upon which are mounted TECD strips 4. The TECD strips are covered by a layer of suitable material which is preferably electrically insulating but heat conducting, such as, a thin metal oxide ceramic 6. Layer 6 is preferably covered by a thin sleeve 8 of a material suitable for contacting a toner image and which sleeve defines a fusing surface 10. The sleeve 8 can be a 0.025 mm thick polyimide or fluorocarbon film or a 0.025 mm thick metal, such as aluminum or copper. The metal can be covered by a polymeric coating to improve release and gloss. A polyimide or other polymer may also be used as an alternative to ceramic 6 in applications not requiring high fusing nip pressures.

Figure 2:
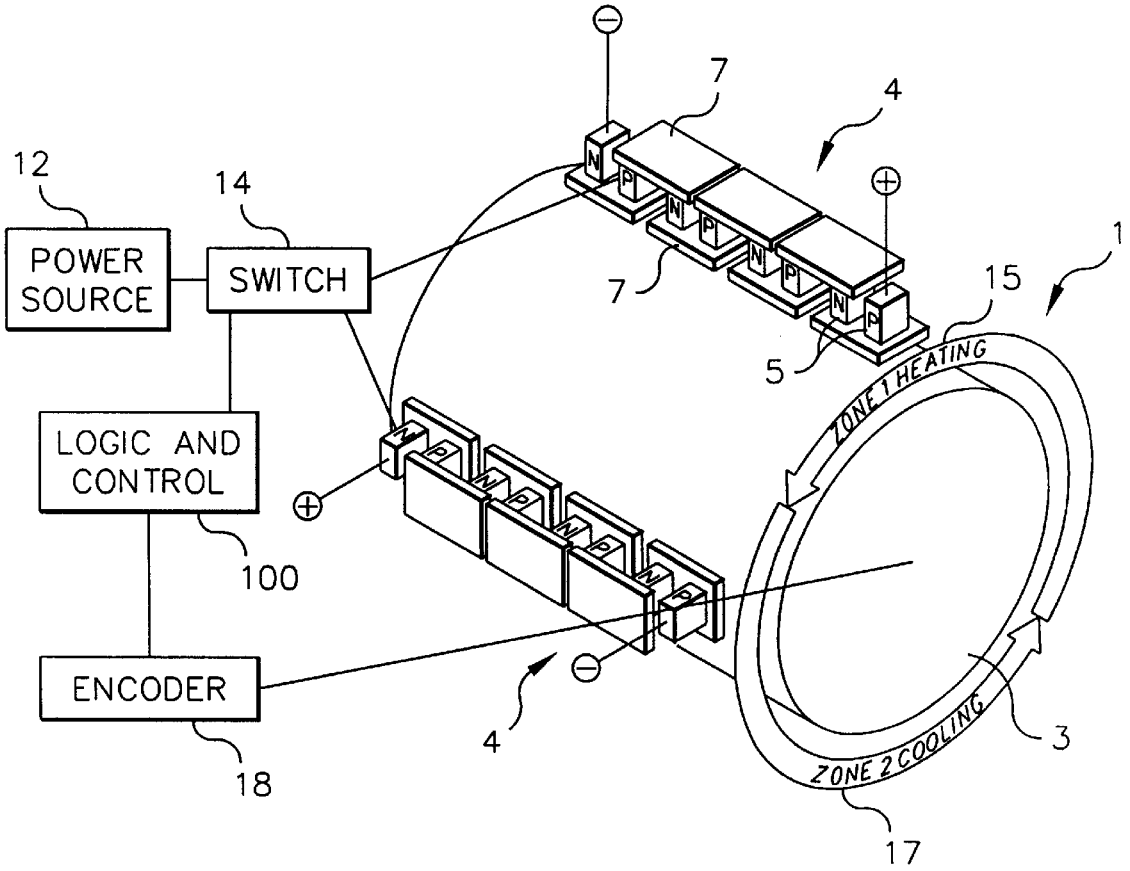
FIG. 2 is a perspective schematic of an internal portion of a fusing roller with parts eliminated for clarity of illustration.

The TECD strips 4 are best seen in FIG. 2, exaggerated in size, with respect to core 3. The TECD is made up of N and P elements 5 which are connected in series, as shown, by copper buss bars 7.

The thermoelectric couples in many TECDs presently manufactured can be adapted for high temperature use and made suitable for this application. A thermoelectric control device which can be so adapted is available from Melcor Corporation, identified as Model FCO.45-4-05 which has outer dimensions on its cold side of 1.8 mm×3.4 mm (0.07"×0.14") with maximum heat transfer capacity of 23 W/in.$^2$ for no temperature difference generated between its hot and cold faces. This model comprises four side-by-side pairs of 0.45 mm×0.45 mm elements, each 1.5 mm high. A custom made analogue of a newly announced model from Melcor Corporation, suitable for use at fusing temperatures, identified as Model HT6-12-40, but with thermoelements cut to narrower cross-sectional dimensions of 0.45 mm×0.45 mm and with maximum heat transfer capacity of 23 w/sq. in. for no temperature difference generated between its hot and cold faces, is also suitable for this application.

Preferably, a strip of thermoelectric couples of these sizes and types (and adapted for the temperatures of intended use) is positioned only one couple wide, spanning the full width of the fuser roller. A preferred fusing member 1, constructed as a roller, has an outer diameter of 2.5 in. and accommodates 90 thermoelectric strips around its perimeter. As can be seen from the FIGS., N and P elements alternate in the cross-track direction. The elements in each strip are electrically in series. Each strip is connected to a power source 12 independently of the other strips. This allows a switch 14, controlled by logic and control 100 working off an encoder 18, to control the polarity of the strips according to their angular position around fusing member 1 and the angular position of fusing member 1.

Figure 3:
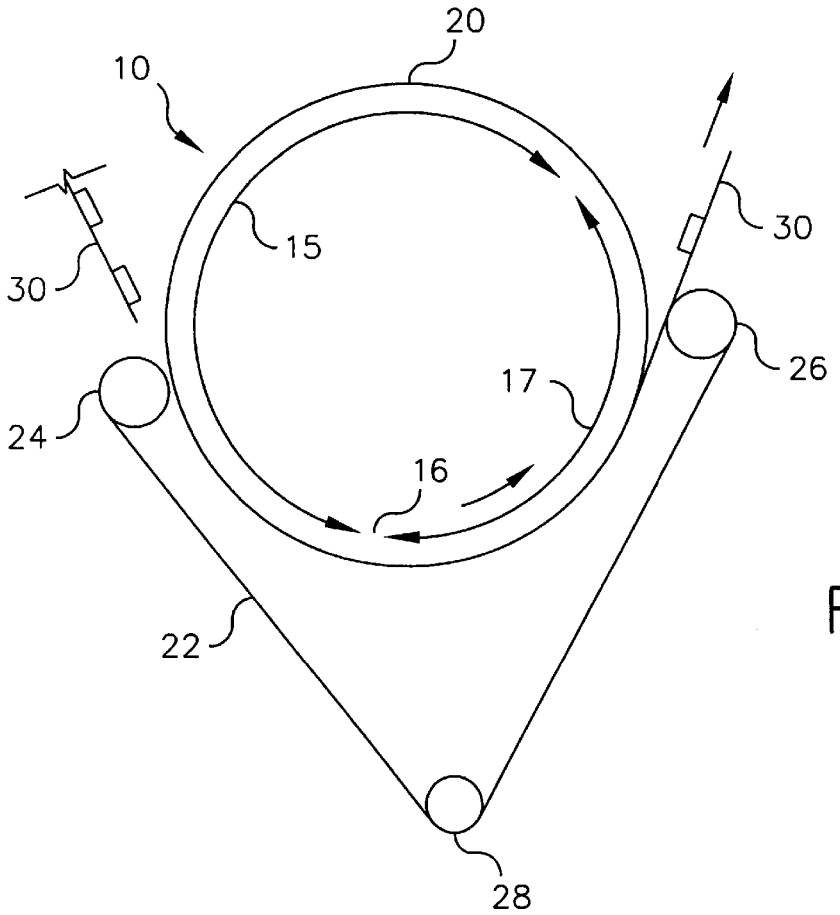
FIGS. 3 and 4 are side schematics of alternative fusers.
Figure 4:
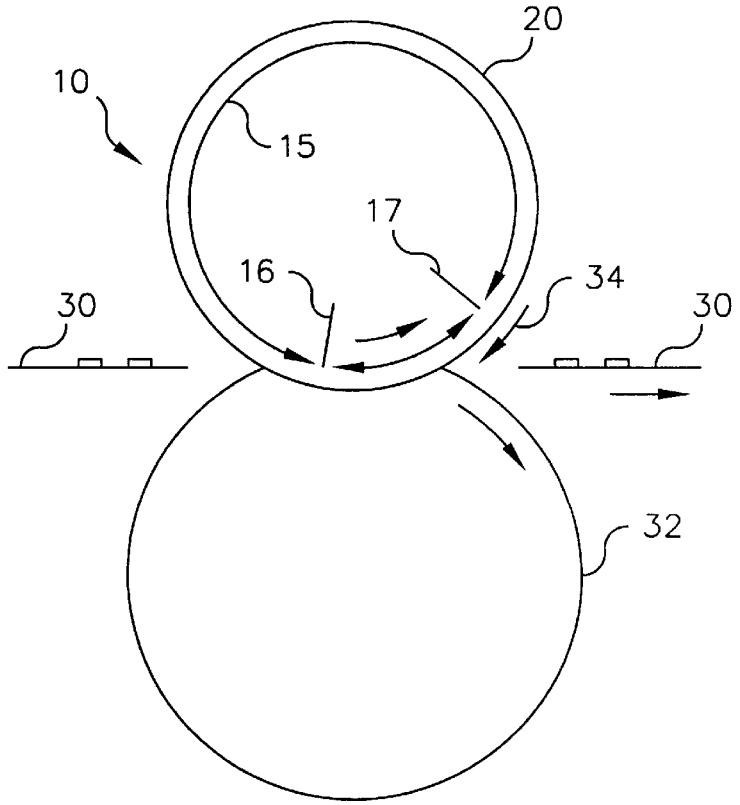

Operation of the invention will be best understood with respect to the embodiments shown in FIGS. 3 and 4. According to FIG. 3, the fusing member is a fusing roller 20 constructed like fusing member in FIGS. 1 and 2. A pressure belt 22 is trained about three rollers 24, 26 and 28. A receiving sheet 30 is fed into a nip formed between roller 24, belt 22 and fusing roller 20, with a toner image on its upper surface contacting fusing surface 10 of fusing roller 20. Preferably, roller 24 is a compliant pressure roller for applying pressure in the nip with fusing roller 20. As the sheet 30 moves in an in-track direction, it is driven by contact with its backside by belt 22 and by fusing roller 20 which, in turn, are driven by a suitable drive connected to one or both.

Strips 4 (FIGS. 1 and 2) are connected to power source 12 in a polarity causing their faces adjacent fusing surface 10 to become heated as long as they are moving through a heating zone 15. Heating zone 15 extends at least from substantially before the beginning of the nip at roller 24 until a position into the nip, transition point 16. At this point, the combination of pressure from roller 24 and heat from the thermoelectric couples has effected fusing. The toner is typically above its glass transition temperature. From transition point 16 on, in the in-track direction, the TECD strips are switched in polarity by switch 14 so that they are now cooling through a cooling zone 17 until the sheet is clearly separated from fusing roller 20. At this point, the polarity is switched back to a heating polarity by switch 14 (as controlled by logic and control 100) so that the fusing surface 20 can, again, be heated up for entering the nip with roller 24.

Roller 26 preferably does not press belt 22 against fusing roller 20 and, thus, can be used to separate sheet 30 from roller 20, for example by moving belt 22 around a sharp bend.

Note that the primary function of belt 22 is to hold the sheet 30 against fusing surface 10 and to help in the separation of sheet 30 from surface 10. Belt 22 can be eliminated, providing the beam strength of sheet 30 allows it to follow fusing surface 10 through a desired contact distance. Skive fingers can be used to separate sheet 30 from fusing surface 10, if necessary, depending upon materials, in each instance. If the receiving surface is on a web, the belt 22 is also unnecessary and the web is threaded around rollers 20, 24 and 26.

FIG. 4 shows an embodiment similar to that of FIG. 3, except that fusing belt 22 is replaced by a large pressure roller 32. Pressure roller 32 is of relatively compliant material which forms a relatively long nip 34 through which sheet 30 can pass through both heating and cooling zones 15 and 17, respectively, to accomplish the same result as in FIG. 3.

The location of transition point 16 can be altered by a program adjustment to logic and control 100. This allows a fine tuning of the process for varying materials, conditions and glosses desired. Location of the transition point 16 from the heating zone to the cooling zone is accomplished empirically. It is the point at which the toner attains a sufficient fusing temperature, by diffusion and conduction of the heat from the elements 5 as they rotate through the heating zone 15 to provide the type of image desired. For example, the temperature at the exit of the heating zone is preferably about 325° F. for conventional toners, and the temperature, as the sheet 30 is separated from fusing surface 10, is about 150° F., also for conventional toners. Such temperatures will, of course, vary according to specific toners used and how much gloss is desired.

According to another preferred embodiment, a fuser similar to that shown in FIG. 4 is produced, except that roller 20 is used as the pressure roller instead of the fusing roller. In this instance, roller 32 is a conventional fusing roller with a compliant elastomer coating and an internal heating lamp, and the fuser is used to fuse both simplex and duplex color images. The TECD strips in roller 20, now the pressure roller, are used to cool the second pass of a duplex image. That is, they cool the first image while the second image, on the opposite side, is being fused. This prevents the first image from being fully fused twice and allows it to match the gloss of the second image and also the gloss of a simplex image. In its simplest form, the thermoelectric couples do not have to be switched. However, extra control can be added to the system providing a small heating zone at the very beginning of the nip and an extended cooling zone through the rest of the nip. With this feature, control of gloss on the first image, which contacts the pressure roller 20, can be effected by varying the position of transition point 16.

In each of the examples it may be helpful to augment the heating portion with auxiliary heat-applying devices. For example, the image on sheet 30 can be preheated either by passing the sheet over a heated plate or by the use of a low powered radiant heater, such as an infrared lamp before entering the fusing nip. The heating zone can then be made much smaller, providing more time for the cooling zone to be effective. It still allows a transition point that can be varied to control the process.

Although the most remarkable uses of the TECDs involve their switching from heating to cooling in the middle of the process, they are advantageously used without relying on this effect. For example, TECDs can be positioned in sliding contact with a fusing member, such as a belt, to heat and cool, or to cool only. The use of TECDs provides very localized heating and cooling that can be quickly adjusted electrically. In these embodiments, the thermoelectric couples can be fixed and slide on any moving surface that can conveniently transmit a cooling (or heating) effect to the toner. For example, they can slide on the inside of a fusing or pressure roller, on the inside of a belt or on the back of a receiving sheet or web.

Although the invention has been described primarily with respect to fusing toner images, it can be used to fuse toner not in image configuration. For example, it can be used to fuse clear toner to a surface (which can carry an image, for example, a fused toner image or another type image) to protect the surface or improve its gloss.

The invention has been described in detail with particular reference to a preferred embodiment thereof, but it will be understood that variations and modifications can be effected within the spirit and scope of the invention as described hereinabove and as defined in the appended claims.

We claim:

1. A fuser for fusing toner carried on a receiving surface moving in an in-track direction, said fuser including:

a fusing member having a fusing surface for contacting the toner, said surface being movable with the toner as the receiving surface and fusing surface move in the in-track direction first through a heating zone and then through a cooling zone, means for heating the toner while the toner is in the heating zone to soften the toner, means for cooling the toner while the toner is in the cooling zone and still in contact with the fusing surface, and means for separating the surfaces after the toner has passed through the cooling zone, wherein said means for heating the toner and said means for cooling the toner include a thermoelectric control device (TECD) including at least one thermoelectric couple capable of controlling temperature of the fusing surface according to the electric polarity of the TECD, said at least one thermoelectric couple moving with the toner in the in-track direction, and wherein the fuser includes means for switching polarity of said thermoelectric couple as the thermoelectric couple passes from the heating zone to the cooling zone.

2. A fuser according to claim 1 wherein said means for cooling the toner has sufficient capacity to cool the toner below its glass transition temperature prior to separation of the receiving surface from the fusing surface by said means for separating.

3. A fuser according to claim 1 wherein said fusing member is a fusing roller having a core and TECD strips positioned on the core across the in-track direction of the receiving surface, which strips are separately electrically controllable and the fuser further includes means for controlling the polarity across process elements of the strips according to the angular position of the fusing roller.

4. A fuser according to claim 1 further including a pressure means positioned to cooperate with the fusing surface to apply pressure to the toner when the toner is in the heating zone.

5. A fuser according to claim 4 wherein said pressure means is a belt backed by a pressure roller.

6. A fuser according to claim 5 wherein said belt directly contacts the back of a sheet or web defining the receiving surface opposite portions of both the heating zone and the cooling zone.

7. A fuser according to claim 6 wherein said pressure means is a compliant roller and the fusing member is a roller that is less compliant than said pressure means compliant roller.

8. A fuser according to claim 1 wherein the TECD is stationary and in sliding contact with the fusing member.

9. A fuser according to claim 1 wherein the receiving surface is on a sheet or web and the TECD is stationary and in sliding contact with a surface of the sheet or web opposite the receiving surface.

10. A fuser for fusing a toner image carried on a sheet or web moving in an in-track direction, said fuser including a rotatable fusing roller having a fusing surface for contacting the toner image, and a pressure roller for forming a nip with the fusing roller, thermoelectric control strips located in the pressure roller and traversing an in-track direction of a sheet or web carrying a toner image to be fused, and means for applying an electrical potential to the strips to assist in controlling temperature associated with the fuser, said strips being actuated to provide a cooling effect with said sheet or web fed through said nip to provide a temperature gradient between the fusing roller and the pressure roller.

11. A fuser according to claim 10 wherein the thermoelectric control device strips are stationary and are located inside the fusing roller in sliding contact with the fusing roller.

12. A fuser for fusing a toner image carried on a sheet or web moving in an in-track direction, said fuser including a rotatable fusing roller having a fusing surface for contacting the toner image, and a pressure roller for forming a nip with the fusing roller, said fuser comprising:

thermoelectric control device strips as part of and movable with the fusing roller so as to traverse an in-track direction of a sheet or web carrying a toner image to be fused, said thermoelectric control device strips being adjustable between a heating condition and a cooling condition, and means for applying an electrical potential to the strips to assist in controlling temperature associated with the fuser including means for switching said devices between their heating and cooling conditions according to the angular position of the fusing roller.

13. A fuser according to claim 12 wherein the angular position of the fusing roller at which said switching means switches said thermoelectric control device strips from heating to cooling is adjustable to control the gloss on the toner image.

14. A fuser for fixing a second toner image carried on a second side of a sheet or web moving in an in-track direction, which sheet or web contains a partially or completely fixed first toner image on a first, opposite side thereof, said fuser comprising:

a fusing roller having a fusing surface for contacting the second toner image on the second side of the sheet or web, means for heating the fusing surface to fuse the second toner image, a pressure roller engageable with the fusing roller to form a nip for receiving a sheet or web moving in an in-track direction, and means for cooling the pressure roller to prevent excess heating of the first toner image while fusing the second toner image to prevent varying gloss between the first and second toner images.

15. A fuser according to claim 14 wherein the means for cooling includes a thermoelectric control device.

16. A fuser according to claim 15 wherein the thermoelectric control device is movable with the pressure roller and further including means for switching the thermoelectric control device between a heating condition and a cooling condition at a switching position between the beginning and end of the nip.

17. A fuser according to claim 16 wherein said switching position is adjustable to control the gloss on the first toner image.

* * * * *